US007849543B2

(12) United States Patent
Poston, Jr. et al.

(10) Patent No.: US 7,849,543 B2
(45) Date of Patent: Dec. 14, 2010

(54) ENCASEMENT SYSTEMS

(75) Inventors: Wilbur F. Poston, Jr., Cumming, GA (US); Sean Rollo, Maple Ridge (CA)

(73) Assignee: Mattress Safe, Inc., Cumming, GA (US)

( * ) Notice: Subject to any disclaimer, the term of this patent is extended or adjusted under 35 U.S.C. 154(b) by 0 days.

(21) Appl. No.: 12/100,891

(22) Filed: Apr. 10, 2008

(65) Prior Publication Data

US 2008/0250561 A1 Oct. 16, 2008

Related U.S. Application Data

(60) Provisional application No. 60/911,030, filed on Apr. 10, 2007.

(51) Int. Cl.
*A47G 9/02* (2006.01)
*A47C 27/00* (2006.01)

(52) U.S. Cl. ..... 5/699; 5/499; 5/738

(58) Field of Classification Search ..... 5/699, 5/738, 499; 24/387, 388, 436
See application file for complete search history.

(56) References Cited

U.S. PATENT DOCUMENTS

| | | | | |
|---|---|---|---|---|
| 4,815,176 | A * | 3/1989 | Yoshida | 24/387 |
| 5,586,368 | A * | 12/1996 | Nelson | 24/390 |
| 6,189,249 | B1 * | 2/2001 | Hughes | 40/662 |
| 6,497,061 | B1 | 12/2002 | Aleksic et al. | |
| 6,948,207 | B2 * | 9/2005 | Daly | 5/738 |
| 7,200,901 | B2 * | 4/2007 | Pitts et al. | 24/436 |
| 7,552,489 | B2 * | 6/2009 | Bell et al. | 5/499 |
| 2004/0128764 | A1 * | 7/2004 | McGrath et al. | 5/499 |

* cited by examiner

*Primary Examiner*—Michael Trettel
(74) *Attorney, Agent, or Firm*—Thomas, Kayden, Horstemeyer & Risley, LLP

(57) ABSTRACT

In one embodiment, a fabric cover configured to substantially surround a mattress is disclosed. A zipper is coupled to the fabric cover and configured to provide an opening in the fabric cover. The zipper is further has a zipper pull and is configured to be opened and closed by movement of the zipper pull. A zipper anchor is also configured to secure the zipper pull in a position causing the zipper to be substantially closed.

11 Claims, 3 Drawing Sheets

ENCASEMENT SYSTEMS

CROSS REFERENCE TO RELATED APPLICATIONS

This application claims priority to U.S. Provisional Patent Application entitled "MATTRESS ENCASEMENT" filed on Apr. 10, 2007 and assigned application Ser. No. 60/911,030, which is incorporated herein by reference in its entirety.

TECHNICAL FIELD

The invention relates to mattress encasements, and, more specifically, is related to securing a mattress encasement.

BACKGROUND

Zippers can provide an opening into fabrics, particularly fabric covers configured to provide an opening in the fabric. Zippers can more specifically provide an opening into a fabric cover adapted for use as a mattress encasement. When positioned in a closed position, it is known that a zipper may shift from such closed position, though, due to movements in the fabric or mattress when the fabric or mattress is in use.

SUMMARY

Other systems, methods, features, and advantages of this disclosure will be or become apparent to one with skill in the art upon examination of the following drawings and detailed description. It is intended that all such additional systems, methods, features, and advantages be included within this description and be within the scope of the present disclosure.

In one embodiment, a system for encasing a mattress, pillow, or cushion is disclosed. The system includes a fabric cover configured to substantially surround a mattress, pillow, or cushion. A zipper is coupled to the fabric cover, the zipper being configured to provide an opening in the fabric cover, the zipper further having a zipper pull and configured to be opened and closed by movement of the zipper pull along the zipper. The system further includes a zipper anchor, the zipper anchor configured to secure the zipper pull in a position causing the zipper to be or remain substantially closed while the zipper anchor engages the zipper pull.

BRIEF DESCRIPTION OF THE DRAWINGS

Many aspects of the invention can be better understood with reference to the following drawings. The components in the drawings are not necessarily to scale.

DETAILED DESCRIPTION

Figure 1:
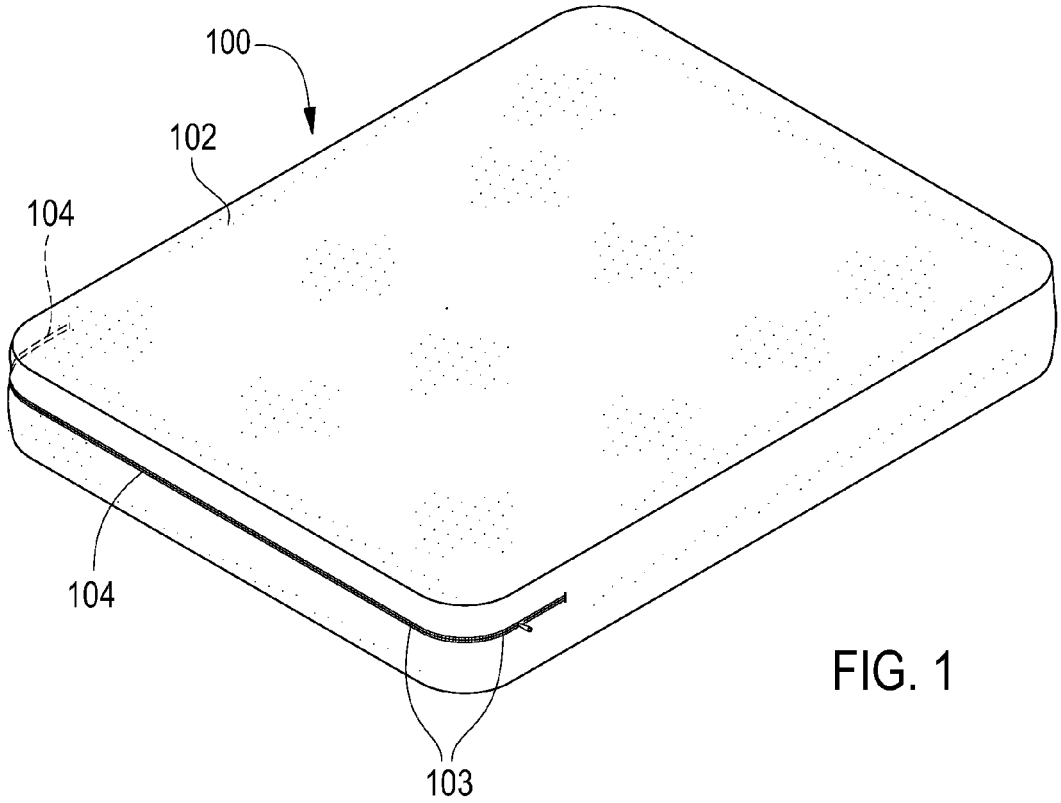
FIG. 1 is a perspective view illustrating an exemplary embodiment of a mattress encasement.

Disclosed are systems for securing and/or fastening a zipper providing an opening in a fabric with a closed position. Additionally, the disclosure is further directed to systems for securing and/or fastening an opening in a mattress encasement. FIG. 1 illustrates a non-limiting exemplary embodiment of a mattress encasement 100. The mattress encasement comprises a cover 102 that has an opening on a side 103 to allow the encasement to cover a mattress (not separately depicted). The opening may be secured closed with a zipper 104.

It should be appreciated that the mattress encasement can take the form of any one of a number of shapes and sizes to fit a variety of types of mattresses. Additionally, the mattress encasement may be manufactured from a number of different materials. These materials may be hypo-allergenic and/or non-porous. The zipper 104 may also be of a size and/or type that prevents microbiological waste, organisms, and/or other allergens from entering or egressing the encasement. It should further be appreciated that the depicted placement of the zipper 104 on the cover 102 is merely exemplary, as it should be appreciated that the zipper 104 can be located on any surface of the cover 102 such that it is configured to provide an opening to open and/or remove the cover 102 from a mattress.

Figure 2:
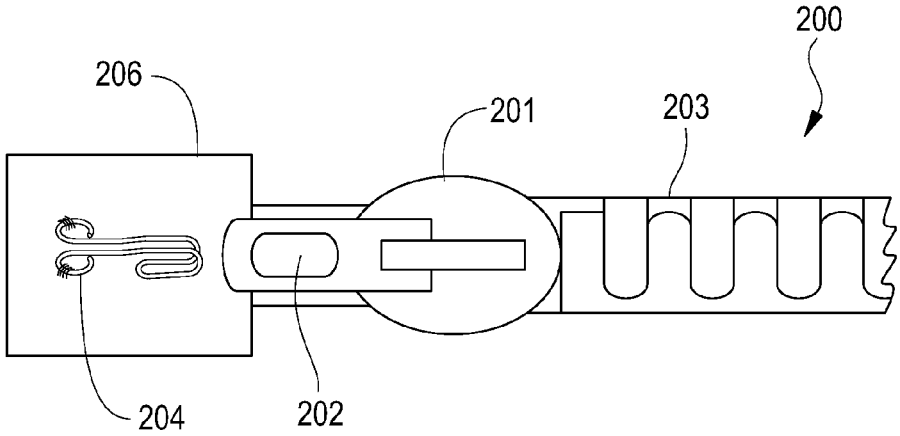
FIG. 2 illustrates an exemplary embodiment of a zipper anchor.

FIG. 2 illustrates a zipper securing mechanism 200 that includes a zipper 203. It should be appreciated that due to use of a mattress or other movement of a fabric, a zipper providing an opening therein may shift or move. This can be notable in the case of a mattress encasement made of a hypoallergenic or other similar material designed to reduce or eliminate the passage of organisms, allergens or other microbial waste. If such a zipper shifts from a closed position, organisms, allergens and/or other microbial waste may pass through a fabric cover, thereby reducing the effectiveness of such a mattress encasement.

Accordingly, in the depicted embodiment of FIG. 2, the zipper pull 201 has an aperture or eye 202. When the zipper 203 is closed, the eye 202 may engage a zipper anchor 204 that is coupled to a mattress encasement (not shown in FIG. 2). It should be appreciated that the zipper anchor 204 can include a hook, button, rivet, or other device that secures the zipper pull 201. It should further be appreciated that the depicted zipper anchor 204 may be sewn, affixed by an adhesive, or otherwise attached to a mattress encasement in accordance with the disclosure. The zipper anchor 204 can prevent the zipper pull 201 from traveling or otherwise moving along the depicted zipper 203 in a manner to open or "unzip" the zipper unless the zipper anchor 204 is disengaged from the eye 202. Thus, the zipper anchor 204 is configured to secure the zipper pull 201 to be or remain in a closed or substantially closed position.

In the non-limiting embodiment depicted in FIG. 2, the zipper anchor 204 is sewn onto an anchor fabric or fabric tab 206. The fabric tab 206 is then coupled to the cover 102. It should be appreciated that the fabric tab 206 can be sewn, attached by an adhesive, hook and loop fasteners, or coupled in various ways to the cover 102. Alternatively, the zipper anchor 204 can be an integrated component of the mattress encasement 100. In other words, the zipper anchor 204 may be coupled directly to a mattress encasement rather than to an anchor fabric 206 as illustrated in FIG. 2. In addition, the present disclosure can also be employed in other types of encasements including, but not limited to, pillow encasings, sofa cushion encasings, chair cushion encasings, and other encasings including fabric.

Figure 3:
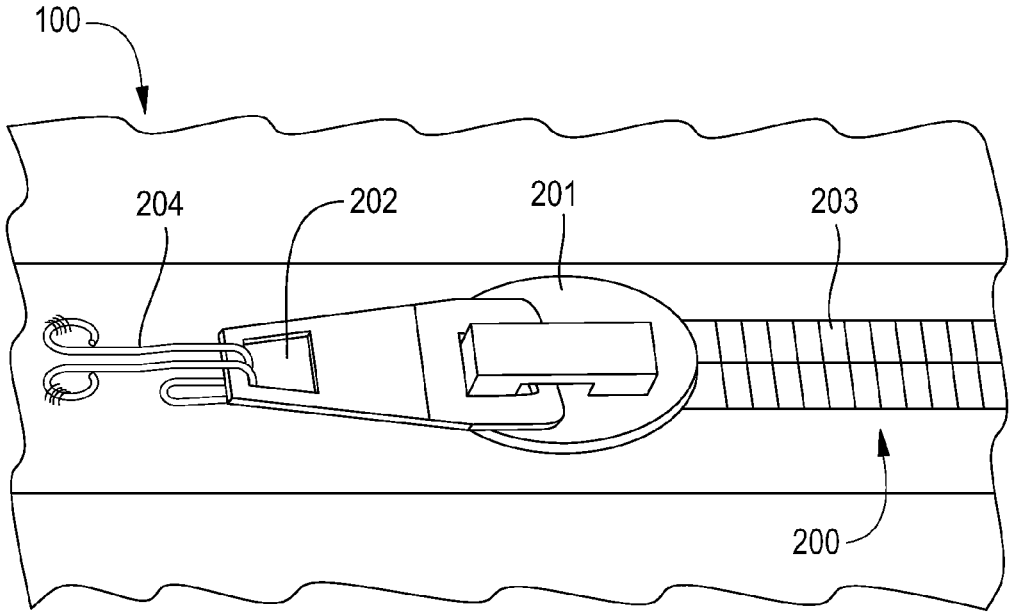
FIG. 3 illustrates an exemplary embodiment of the zipper anchor of FIG. 2.
Figure 4:
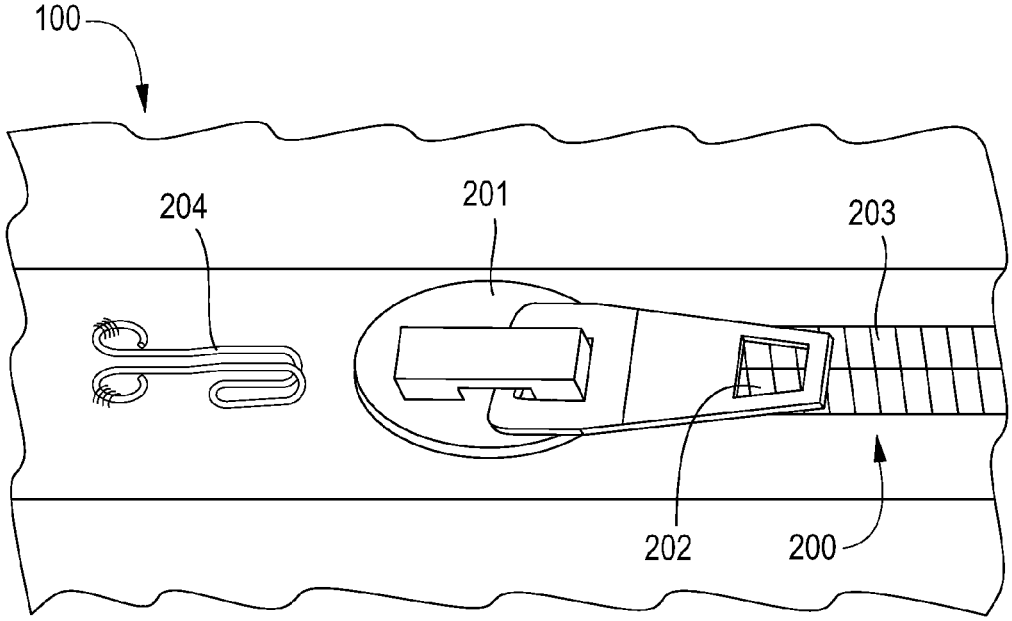
FIG. 4 illustrates an exemplary embodiment of the zipper anchor of FIG. 2.

FIG. 3 depicts an alternative illustration of a zipper 203 having a zipper pull 201 and eye 202 that is secured in a closed position in accordance with the disclosure. In the illustrated depiction, zipper anchor 204 secures zipper pull 201 by way of a hook extending and/or protruding through eye 202. In addition, the zipper anchor 204 is depicted as coupled to a mattress encasement 100 by way of sewing. Alternatively, FIG. 4 depicts an additional illustration of a zipper 203, zipper pull 201 having an eye 202, and a zipper anchor 204. In the illustration of FIG. 4, the zipper is depicted in a closed position; however, zipper anchor 204 is not securing the zipper 203 in a closed position.

Figure 5:
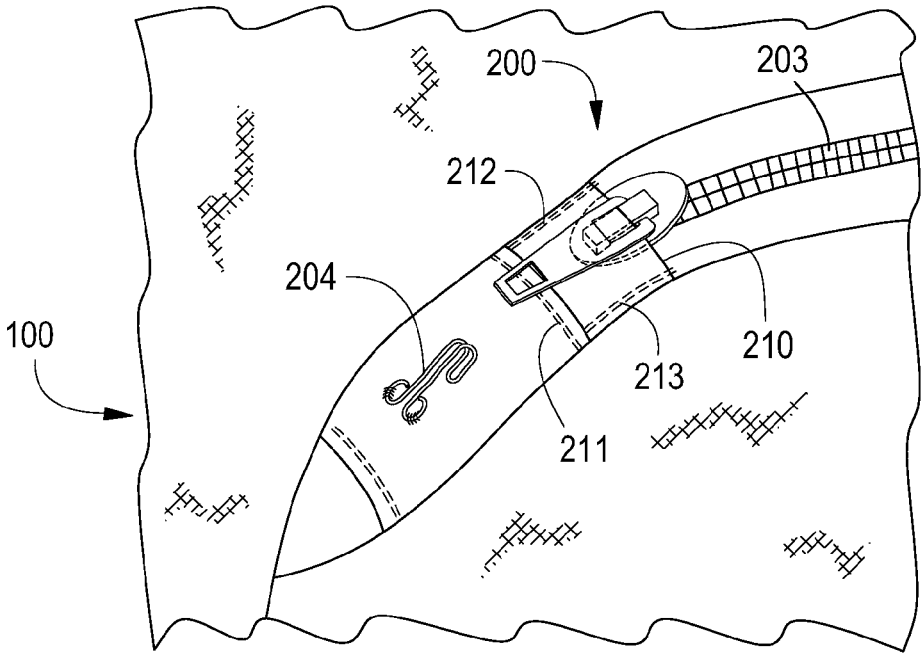
FIG. 5 illustrates an exemplary embodiment of a zipper anchor and zipper termination shroud.

FIG. 5 depicts an additional non-limiting exemplary embodiment of a zipper securing mechanism 200. As noted above in reference to FIGS. 2-4, a zipper anchor 204 is disclosed, which can anchor the zipper 203 in a closed position 204. Accordingly, the zipper anchor 204 can help prevent ingress and/or egress of organisms, contaminants, microbial waste and/or other allergens through the mattress encasement composed of hypoallergenic or other similar fabric. Additionally, a zipper termination shroud 210 is disclosed. The zipper termination shroud 210 is configured to substantially surround the termination or end of the zipper 203. The zipper termination shroud 210 is further depicted in FIG. 6, which illustrates an opposing surface of the zipper securing mechanism 200.

Figure 6:
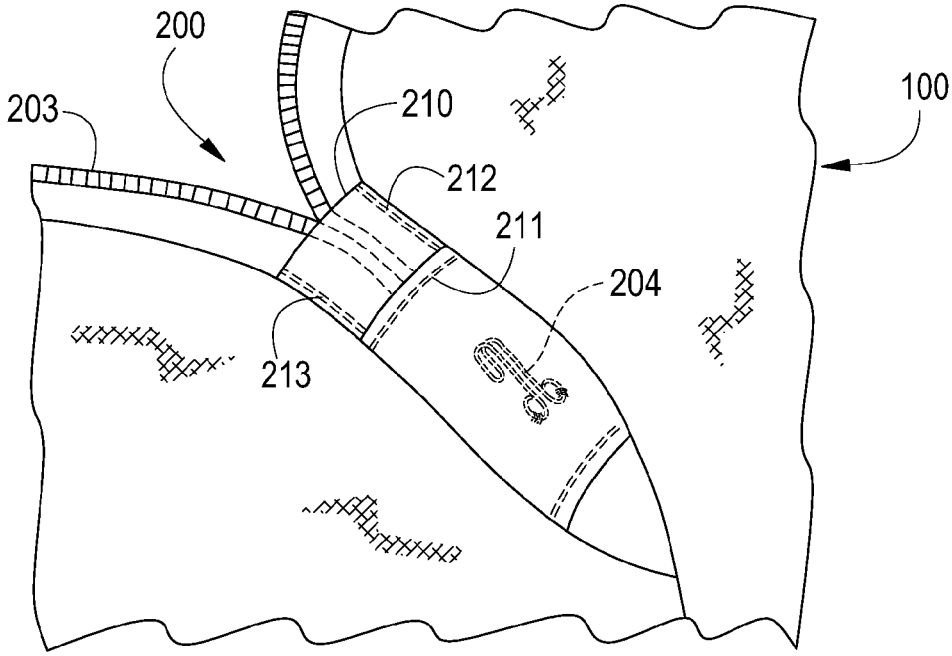
FIG. 6 illustrates an alternative view of the exemplary embodiment of FIG. 5.

It should be appreciated from the depicted exemplary embodiment of FIGS. 5-6 that the zipper termination shroud 210, zipper 203, and zipper anchor 204 can act in concert to improve the resistance of a mattress encasement 100 to ingress and/or egress of organisms, microbial waste and/or other allergens. For example, the zipper termination shroud 210 can comprise a hypoallergenic fabric or other fabric providing resistance to passage of organisms, allergens and/or other microbial waste.

Accordingly, when the zipper is positioned in a closed position, a zipper pull can be anchored by the zipper anchor 204 in a closed position underneath or adjacent to the zipper termination shroud 210. Because it should be appreciated that a zipper termination can often be the weakest point of a mattress encasement with regard to preventing ingress and/or egress of contaminants, such a configuration can improve resistance of an encasement to ingress and egress of contaminants. Additionally, the zipper termination shroud 210 can be sewn to the mattress encasement 100 by stitching 211, 212, and 213, which provides a "tunnel" access for the zipper pull to approach a zipper termination. However, because the zipper termination shroud 210 can include fabric above and below the zipper 203 that is attached via stitching 211, 212, and 213, the zipper termination shroud 210 can reduce or eliminate ingress and/or egress of contaminants at or near a potential weak point of the zipper 203. Therefore, the zipper termination shroud 210 is configured so as to provide a seal between an exterior and an interior of the mattress encasement at a potential point of weakness: the termination of the zipper 203.

It should be emphasized that the above-described embodiments are merely possible examples of implementations of the devices and methods, and are merely set forth for a clear understanding of the principles set forth herein. Many variations and modifications may be made to the devices and methods without departing substantially from the spirit and principles of the disclosure. All such modifications and variations are intended to be included herein within the scope of this disclosure.

Having thus described the invention, at least the following is claimed:

1. A system for encasing, comprising:

a fabric cover configured to substantially surround a mattress;

a zipper coupled to the fabric cover, the zipper configured to provide an opening in the fabric cover, the zipper further having a zipper pull and configured to be opened and closed by movement of the zipper pull along the zipper;

a zipper anchor, the zipper anchor configured to secure the zipper pull in a position causing the zipper to be substantially closed, the zipper anchor further being aligned with a longitudinal axis of the zipper; and a zipper termination shroud coupled to the fabric cover, the zipper termination shroud further comprising a first portion configured to provide access to a zipper termination for the zipper pull and substantially surrounding a remainder of an outer portion of the zipper termination, and a second portion configured to substantially surround an inner portion of the zipper termination, the second portion further configured to seal the inner portion of the zipper termination.

2. The system of claim 1, wherein the zipper anchor is coupled to the fabric cover.

3. The system of claim 2, wherein:

the zipper anchor is sewn onto an anchor fabric; and the anchor fabric is coupled to the fabric cover.

4. The system of claim 1, wherein the zipper pull further comprises a zipper anchor aperture.

5. The system of claim 4, wherein the zipper anchor is configured to secure the zipper pull by protruding through at least a portion of the zipper anchor aperture.

6. The system of claim 1, wherein the zipper anchor is at least one chosen from: a hook, a rivet, a snap, and a button.

7. The system of claim 1, wherein the fabric cover further comprises at least one fabric chosen from: a hypoallergenic fabric, a dust-mite resistant fabric, and a non-porous fabric.

8. The system of claim 1, wherein the zipper termination shroud is a fabric comprising at least one chosen from: a hypoallergenic fabric, a dust-mite resistant fabric, and a non-porous fabric.

9. The system of claim 1, wherein the zipper is configured to substantially restrict passage of at least one of: organisms, microbial waste and allergens.

10. A system, comprising:

means for encasing at least one of: a mattress, a pillow, and a cushion;

means for providing an opening into the encasing means, the opening providing means configured to be retractable;

means for engaging and anchoring the opening providing means in a closed position, the engaging and anchoring means being aligned with a longitudinal axis of the opening providing means; and means for sealing the opening providing means, wherein the sealing means further comprises a first portion configured to provide access to a termination of the opening providing means and substantially surrounding a remainder of an outer portion of a termination of the opening providing means, and a second portion configured to substantially surround an inner portion of the termination of the opening providing means, the second portion further configured to seal the inner portion of the termination of the opening providing means.

11. The system of claim 10, wherein the engaging and anchoring means is coupled to the encasing means.

* * * * *